United States Patent [19]

Baker et al.

[11] Patent Number: 4,525,173

[45] Date of Patent: Jun. 25, 1985

[54] MINERAL SLURRIES

[75] Inventors: Peter J. Baker, Daventry; David A. Brookes, Orpington; Martin Johnson, Oakley, all of England

[73] Assignee: The British Petroleum Company p.l.c., London, England

[21] Appl. No.: 495,420

[22] Filed: May 17, 1983

[30] Foreign Application Priority Data

May 19, 1982 [GB] United Kingdom ..... 8214648

[51] Int. Cl.[3] ..... C10L 1/32

[52] U.S. Cl. ..... 44/51; 406/47; 406/49; 406/197

[58] Field of Search ..... 44/51; 406/47, 49, 197; 241/20, 24

[56] References Cited

U.S. PATENT DOCUMENTS 3,168,350 2/1965 Phinney et al. ..... 44/51
3,762,887 10/1973 Clancey et al. ..... 44/51
3,908,912 9/1975 Irons et al. ..... 241/24
4,132,365 1/1979 Verschuur ..... 241/24

FOREIGN PATENT DOCUMENTS 0050412 4/1982 European Pat. Off. ..... 44/51
2068056 8/1981 United Kingdom .

*Primary Examiner*—Ferris H. Lander
*Assistant Examiner*—Margaret B. Medley
*Attorney, Agent, or Firm*—Morgan, Finnegan, Pine, Foley & Lee

[57] ABSTRACT

A pumpable slurry of mineral particles, e.g., coal, in water contains 50 to 85% by weight of mineral particles based on the combined weight of mineral particles and water. The mineral component contains at least 30% by weight of coarse particles having a particle size in the range 5 to 50 mm, 10 to 40% by weight of fine particles having a particle size less than 200 micron and the balance to 100% of intermediate sized particles.

The slurry is stable without the use of additives and can be pumped through a pipeline.

8 Claims, No Drawings

MINERAL SLURRIES

This invention relates to a pumpable slurry of particles of a mineral such as coal in water and to a method for transporting such a slurry.

There have been previous proposals to transport coal by preparing slurries of particles of coal in water and pumping the slurries through pipelines. These slurries tend to be unstable and the coal tends to sediment.

GB 2068056-A discloses a method of transporting coal as a coal water slurry through a pipeline wherein the coal in the slurry comprises at least 95% by weight of coal particles having a particle size smaller than 700 micron and at most 10% by weight of coal particles having a particle size smaller than 44 micron.

There have also been proposals to provide slurries of coal particles in water for use as fuels. However, such slurries are based on even finer particles.

It is an object of the present invention to provide a pumpable slurry of improved stability containing relatively large size mineral particles in water.

According to the present invention there is provided a pumpable slurry of mineral particles in water comprising coarse mineral particles having a particle size in the range 5 to 50 mm and fine mineral particles having a size less than 200 micron wherein the slurry contains 50 to 85% by weight of mineral particles based on the combined weight of mineral particles and water, at least 30% by weight of the mineral particles being in the form of coarse particles, 10% to 40% weight being in the form of fine particles, and the balance to 100% by weight being intermediate sized particles.

Above 85% by weight, the slurry becomes too viscous to be pumped and below 50% the slurry is unstable and suspended particles settle out.

Preferably the slurry contains 65% to 80% by weight of mineral particles.

Preferably the fine particles contain a significant proportion, eg at least 50% by weight, of particles less than 100 micron in size.

Desirably the fine particles have a low content, eg, less than 10% by weight of particles less than 10 microns in size as these tend to increase the viscosity of the slurry, although some at least should be present.

Conveniently the mineral particles have a continuous particle size distribution. This may be chosen to obtain the closest packing of particles.

The preferred mineral for use in a slurry according to the present invention is coal, but coal waste and ores of copper, nickel and gold are also suitable.

A slurry according to the present invention has a high viscosity when static and a low viscosity after shearing and in motion. It is stable without requiring the addition of a stabiliser. The flow of slurry can be stopped, started and the velocity altered at will without causing sedimentation of coarse particles or pipeline blockage.

According to another aspect of the present invention, there is provided a method for transporting a pumpable slurry of mineral particles in water through a pipeline which method comprises pumping a slurry as hereinbefore described through the pipeline.

It is believed that in motion the fine particles concentrate at the wall of the pipeline and the coarse particles at the core. The fines at the pipeline wall act as a lubricant for the coarse particles at the core.

The pipelines may be primed with a slurry of the fines to prevent difficulties in starting up.

Conveniently the fines may be separated at the distant end of the pipeline and returned to the rear end for re-use.

Separation may be effected by diluting the slurry with further quantities of water to reduce its stability followed by filtration and/or centrifuging.

The fines can be returned as a slurry in water through another pipeline. Conveniently the loading of fines in the returned slurry is about 50–65% by weight.

According to a further aspect of the invention there is provided a mineral in the form of a pumpable slurry as hereinbefore described, wherein the mineral comprises at least 30% by weight of coarse particles having a particle size in the range of 5 to 50 mm, based on the total weight of mineral particles, 10 to 40% by weight of fine particles having a particle size less than 200 micron, and the balance to 100% by weight of intermediate sized particles.

The invention is illustrated with reference to the following example.

EXAMPLE

A 1:1 by weight mixture of pulverised Grimethorpe coal fines (particle size less than 100 micron) and water was slurried in a cement mixer. Two parts by weight unwashed Coventry coal (particle size in the range 5 to 50 mm) were then mixed in.

The resulting slurry was then pumped under non-turbulent flow conditions through a 100 m long 8 inch diameter (20.32 cm) pipeline using a Putzmeister BRF 211 concrete pump.

Samples of the slurry were taken from the pipeline at the times indicated in Table 1 and 2 and the particle size distribution of the sample was determined and recorded in Table 2.

The example shows that a slurry according to the present invention can be pumped under conditions of non-turbulent flow and the slurry is stable and pumpable without the use of additives such as surfactants which have previously been proposed to prevent aggregation of coal particles.

TABLE 1

| Flow Velocity (m/s) | Delivery Pressure (bar) | Wall Shear Stress ($N/m^2$) | Time |
|---|---|---|---|
| 0.62 | 8.0 | 387 | 10-45 |
| 0.47 | 8.25 | 400 | 11-05 |
| 0.74 | 9.2 | 447 | 11-10 |
| 0.70 | 4.6 | 217 | 11-30 |
| 1.01 | 6.1 | 292 | 11-35 |
| 0.51 | 7.1 | 342 | 12-17 |
| 1.05 | 9.7 | 472 | 12-25 |
| 0.68 | 5.4 | 257 | 12-32 |
| 0.68 | 5.0 | 237 | 12-33 |
| 0.68 | 4.0 | 187 | 12-35 |
| 0.68 | 3.0 | 137 | 12-38 |
| 0.68 | 2.5 | 112 | 12-41 |
| 0.68 | 2.0 | 87 | 12-43 |
| 0.68 | 1.5 | 62 | 12-46 |
| 0.68 | 1.5 | 62 | 13-20 |
| 0.68 | 1.0 | 37 | 13-23 |
| 0.68 | 0.5 | 15 | 13-29 |
| 0.51 | 4.6 | 217 | 14-56 |
| 0.51 | 4.75 | 224 | 15-05 |
| 0.51 | 4.95 | 235 | 15-30 |
| 0.51 | 5.10 | 242 | 15-48 |
| 0.51 | 5.6 | 267 | 15-55 |
| 0.51 | 5.6 | 267 | 15-55 |

TABLE 2

| Sampled at Time | WET SCREEN ANALYSIS OF COAL SAMPLES FROM 8" PIPELINE TRIALS CUMULATIVE PERCENT PASSING SCREEN SIZE IN mm | | | | | | | | | | |
|---|---|---|---|---|---|---|---|---|---|---|---|
| | 37.5 mm | 18.0 mm | 9.0 mm | 4.0 mm | 2.0 mm | 1.0 mm | 0.5 mm | 0.25 mm | 0.125 mm | 0.063 mm | 0.04 mm |
| 10–45 | 100.00 | 93.93 | 70.59 | 54.83 | 48.71 | 44.57 | 41.68 | 39.44 | 37.20 | 33.09 | 30.44 |
| 11–05 | 100.00 | 100.00 | 63.98 | 41.45 | 35.67 | 32.40 | 30.32 | 28.70 | 27.01 | 24.32 | 22.73 |
| 11–10 | 100.00 | 94.43 | 64.10 | 44.14 | 38.53 | 35.22 | 32.83 | 31.03 | 29.16 | 26.02 | 24.72 |
| 11–30 | 100.00 | 90.23 | 66.59 | 46.86 | 40.80 | 37.31 | 35.16 | 33.40 | 31.52 | 28.43 | 25.50 |
| 12–17 | 100.00 | 90.80 | 66.48 | 45.86 | 39.88 | 36.33 | 34.03 | 32.16 | 30.25 | 27.43 | 25.21 |
| 12–25 | 100.00 | 86.18 | 66.30 | 48.97 | 42.56 | 38.41 | 35.77 | 33.68 | 31.53 | 28.58 | 26.98 |
| 12–33 | 100.00 | 83.32 | 58.14 | 36.77 | 30.30 | 26.98 | 25.04 | 23.58 | 22.10 | 19.97 | 18.45 |
| 12–35 | 100.00 | 83.99 | 56.90 | 40.49 | 35.29 | 32.06 | 30.03 | 28.39 | 26.71 | 24.31 | 23.00 |
| 13–23 | 100.00 | 79.73 | 54.36 | 36.88 | 32.11 | 29.32 | 27.68 | 26.24 | 24.75 | 22.42 | 20.45 |
| 13–29 | 100.00 | 87.95 | 57.08 | 36.93 | 31.14 | 27.94 | 26.13 | 24.62 | 23.15 | 21.01 | 19.54 |
| 14–56 | 100.00 | 95.36 | 64.25 | 40.00 | 32.13 | 27.35 | 24.65 | 22.63 | 20.81 | 18.62 | 17.50 |
| 15–55 | 100.00 | 92.06 | 62.65 | 37.91 | 30.39 | 26.61 | 24.38 | 23.42 | 22.10 | 20.27 | 18.65 |

We claim:

1. A pumpable slurry of coal particles in water consisting essentially of coarse coal particles having a particle size in the range 5 to 50 mm and fine coal particles having a particle size less than 200 micron wherein the slurry contains 50 to 85% by weight of coal particles based on the combined weight of coal particles and water, at least 30% by weight of the coal particles being in the form of coarse particles, 10% to 40% by weight being in the form of fine particles and the balance to 100% by weight being intermediate sized particles.

2. A pumpable slurry according to claim 1 wherein the slurry contains 65% to 80% by weight of coal particles.

3. A pumpable slurry according to claim 1 wherein at least 50% by weight of the fine particles are less than 100 micron in size.

4. A pumpable slurry according to claim 1 wherein the fine particles contain less than 10% by weight of particles having a particle size below 10 micron.

5. A pumpable slurry according to claim 1 wherein the coal particles have a continuous particle size distribution.

6. A method for transporting coal particles in water through a pipeline which method comprises pumping through the pipeline a pumpable slurry consisting essentially of coal particles in water comprising coarse coal particles having a particle size in the range of 5 to 50 mm and fine coal particles having a particle size less than 200 micron wherein the slurry contains 50 to 85% by weight of coal particles based on the combined weight of coal particles and water, at least 30% by weight of the mineral particles being in the form of coarse particles, 10 to 40% by weight being in the form of fine particles and the balance to 100% by weight being intermediate sized particles.

7. A method for transporting a pumpable slurry of coal particles in water through a pipeline according to claim 6 wherein the fine particles are separated from the slurry at the distant end of the pipeline and are returned for re-use.

8. A coal in the form of particles suitable for dispersion in water to form a pumpable slurry wherein the coal comprises at least 30% by weight of coarse particles having a particle size in the range of 5 to 50 mm, based on the total weight of coal particles, 10 to 40% by weight of fine particles having a particle size less than 200 micron, and the balance to 100% by weight of intermediate sized particles.

* * * * *